United States Patent [19]

Cummings

[11] 4,214,959

[45] Jul. 29, 1980

[54] METHOD FOR ADJUSTING ANODES

[75] Inventor: Thomas L. Cummings, Ocoee, Tenn.

[73] Assignee: Olin Corporation, New Haven, Conn.

[21] Appl. No.: 33,657

[22] Filed: Apr. 26, 1979

[51] Int. Cl.[2] ..... C25B 1/36
[52] U.S. Cl. ..... 204/99
[58] Field of Search ..... 204/99

[56] References Cited

U.S. PATENT DOCUMENTS

| | | | |
|---|---|---|---|
| 3,558,454 | 1/1971 | Schafer et al. | 204/99 |
| 3,926,750 | 12/1975 | Adachi et al. | 204/99 |
| 3,960,694 | 6/1976 | Champlon et al. | 204/219 |
| 4,082,639 | 4/1978 | Ralston et al. | 204/228 |

FOREIGN PATENT DOCUMENTS

| | | | |
|---|---|---|---|
| 29-23309 | 10/1954 | Japan | 204/99 |

*Primary Examiner*—R. L. Andrews
*Attorney, Agent, or Firm*—Gordon F. Sieckmann; Donald F. Clements

[57] ABSTRACT

An improved method for adjusting the space between an adjustable anode and a cathode in an electrolytic cell wherein current measurements and voltage measurements are obtained and compared with predetermined standards. Measurements of deviation from predetermined standards are employed to determine the direction of anode adjustment. The current is balanced between the individual anode posts of the anode sets and between the individual anode sets of an electrolytic cell within predetermined limits.

19 Claims, 1 Drawing Figure

METHOD FOR ADJUSTING ANODES

The present invention relates to a method for adjusting the anode-cathode spacing in an electrolytic cell.

More particularly, this invention relates to a method for adjusting the anode-liquid cathode spacing in an electrolytic mercury cell for the electrolysis of alkali metal chlorides, such as sodium chloride.

Electrolytic mercury cells have been used commercially in the production of chlorine and sodium hydroxide by the electrolysis of sodium chloride brine for many years. In general mercury cells employ a metal cell container which slopes slightly downward from one end to the other, and utilize a cathode comprised of a flowing stream of mercury on the bottom of the cell. A layer of sodium chloride brine flows on the top of the flowing mercury cathode in the cell container. Electrodes such as anodes, and fabricated either from graphite or metal, are secured to the top of the cell container and are positioned in the brine but above the flowing mercury cathode..

When a voltage is applied across the cell, current flows from the anode through the brine electrolyte to the flowing mercury cathode and causes electrolysis of the brine and the formation of gaseous chlorine, which is removed from the cell, purified, liquified and stored. Elemental sodium, another product of the electrolysis forms and amalgam with the liquid mercury cathode and is removed from the cell and processed to form a sodium hydroxide solution. Regenerated liquid mercury from the amalgam is recycled for use as cell cathode.

A plurality of electrolytic cells are normally electrically connected in an electric series circuit. Typically, the anodes of each electrolytic cell are electrically connected in a parallel circuit. The anodes of each cell may be grouped by physical arrangement into sets. An anode set typically contains in the range from 1 to about 20 anodes.

Each set of anodes of a selected cell may be separately adjustable to raise or lower the anodes of a selected set with respect to the liquid mercury cathode. Each anode set generally contains a plurality of anode posts which support the anodes of that set. Typically, two or four anode posts are employed per anode.

Each anode set may be provided with one or a plurality of anode buses. The anode buses are electrically connected to the cathode side of an adjacent electrolytic cell in the series.

In one type cell design, a motor control circuit and gear system is associated with each anode set to raise or lower all the anodes of that set. According to other cell designs, all the anode sets of a single electrolytic cell are raised and lowered simultaneously. In the latter design, a motor control circuit and gear assembly is associated with the entire group of anode sets to raise or lower all the anode sets of a single electrolytic cell simultaneously.

Whatever the design of the cell, the control of the interelectrode distance between the anode and liquid cathode is economically important. The interelectrode distance should be as small as possible to reduce the wasteful consumption of energy. The interelectrode distance is ordinarily maintained, if possible, in the range from about 0.2 to about 0.6 centimeter when the anodes are metal.

In addition to the problem of maintaining the optimum anode-liquid cathode spacing in mercury cells, the problem of preventing short circuiting due to contact between the flowing mercurcy cathode and an anode is also of importance. Such short circuits may be caused by breakage of a graphite anode, by loosening of anode support posts, by fluctuation in the thickness of flowing mercury layer due to faulty flow control, or other causes which allow the anode to contact the flowing mercury cathode. The resulting short circuit causes an excessive flow of current in the contacting anode and in the anode bus serving that anode. This leads to loss in the production of chlorine gas, excessive hydrogen gas in the chlorine gas, and damage to the anodes. In addition, with metallic anodes, a short circuit damages the active coating and the support structure on the metallic anode, which cannot be economically tolerated.

Various patents describe methods of adjusting the anode to cathode distance by transmitting current and voltage signals to a computer or to some type of visual readout or both. An output signal from the computer is generally coupled to a motor control circuit and gear arrangement so that the anode sets are raised or lowered in response to that output signal. During the startup, an operator, during manual control of the anode sets, can raise or lower the anode sets manually until the desired operating condition is reached. The system is then switched to automatic control.

Such patents include, for example, U.S. Pat. No. 3,574,073, issued Apr. 6, 1971 to Richard W. Ralston, Jr.; U.S. Pat. No. 3,558,454, issued Jan. 26, 1971 to Rolph Schafer et al; U.S. Pat. No. 3,627,666, issued Dec. 4, 1971 to Rene L. Bonfils; U.S. Pat. No. 3,531,392, issued Sept. 29, 1970 to Kurt Schmeiser; U.S. Pat. No. 3,361,564, issued Jan. 2, 1968 to D. Deprez et al; West German Pat. No. 1,804,295, published May 14, 1970; East German Pat. No. 78,557, issued Dec. 20, 1979; U.S. Pat. No. 3,900,373, issued to Richard W. Ralston, Jr. on Aug. 19, 1975; U.S. Pat. No. 3,873,430, issued to Richard W. Ralston, Jr. on Mar. 25, 1975; U.S. Pat. No. 3,844,913, issued Oct. 29, 1974 to Jack Warren; U.S. Pat. No. 4,082,639, issued Apr. 4, 1978 to Richard W. Ralston, Jr. et al; and U.S. Pat. No. 3,390,070, issued June 25, 1968 to Roy M. Cooper et al. The teachings of each of the above patents are incorporated herein by reference in their entirety.

In addition, such patents as U.S. Pat. No. 3,574,073, supra, as well as U.S. Pat. No. 3,844,913, supra, disclose systems for the automatic raising of the anodes or anode sets of a given cell upon the sensing of an overcurrent or short circuit condition.

Despite the aforementioned techniques and others which provide ways of adjusting the anode-cathode spacing in an electrolytic cell, persistent problems remain.

It is well known that in a cell containing a plurality of electrodes, the optimum anode-cathode spacing for a particular electrode will depend on its location in the cell, and its age or length of service, among other factors. For example, in a horizontal mercury cell for electrolyzing alkali metal chlorides, the optimum anode-cathode spacing for an anode located near the entry of the cell is different from the spacing for one located near the cell exit. In addition, decomposition voltage varies throughout the cell as brine temperature and concentration change. Likewise, a new anode can maintain a closer anode-cathode spacing than one which has been in the cell for a longer period of time or can operate more efficiently at the same spacing. In addition, after an anode has been lowered, it is necessary to know whether the anode-cathode spacing is too narrow, which may cause short circuiting or loss of efficiency.

There are other persistent remaining problems in that the individual anode sets of an electrolytic cell are not necessarily current balanced with respect to each other and the individual anode posts within an anode set are not necessarily current balanced with respect to each other.

Thusly, current imbalance within an anode set, and from anode set to anode set in a mercury cell, yields eratic performance comparisons and impedes efforts to obtain optimum adjustment of the anode-cathode distance. This, in turn, results in an overall higher than desired power consumption for that cell.

There is a need at the present time for an improved method and apparatus for controlling the space between an adjustable anode and a cathode which utilizes current measurements, and/or voltage measurements or a combination thereof to effect adjustment of the electrode space of individual anode sets and individual anode posts under the varying conditions occurring in the aforesaid electrolytic cells.

OBJECTS

It is a primary object of this invention to provide an improved method of adjusting anodes in an electrolytic cell.

Another object of this invention is to provide an improved method of adjusting anodes to an optimum interelectrode distance in an electrolytic cell utilizing a flowing liquid cathode.

It is a still further object of this invention to provide an improved method of adjusting the anode-liquid cathode spacing in an electrolytic mercury cell whereby the individual anode posts of a selected anode set within a selected electrolytic cell are current balanced with respect to the other anode posts of the same anode set.

It is another object of this invention to provide an improved method of adjusting the anode-liquid cathode spacing in an electrolytic mercury cell whereby the individual anode sets of selected electrolytic cells are current balanced with respect to other anode sets of the same electrolytic cell.

It is an additional objects of this invention to provide an improved method of adjusting anodes in a mercury electrolytic cell whereby the power consumption and energy consumption are minimized.

BRIEF DESCRIPTION OF THE INVENTION

In a method for adjusting the anode-cathode space between electrodes in an electrolytic cell containing an electrolyte decomposable by an electric current, the electrolyte being in contact with the electrodes, the electrodes being comprised of at least one anode set which is adjustable with respect to a liquid cathode in a spaced relationship, wherein the anode set has at least one electrode and a plurality of anode posts, and wherein a voltage is applied across the cathode and the anode set to develop an electric current flow through the electrolyte to effect the decomposition of the electrolyte and the cell having operably connected to the adjustable anode set a motor drive means attached to raise and lower the adjustable anode set, wherein a series of N current and a series of N voltage measurements to the adjustable anode set are taken and an average current through and an average voltage across the anode set is calculated, the improvement which comprises, in combination, calculating a voltage coefficient, $V_c$, for the anode set, adjusting the anode-cathode space after a comparison of the calculated voltage coefficient, $V_c$, with a previously determining standard voltage coefficient, S, shows that the $V_c$ exceeds a standard deviation range, $k_1$, from said S, further adjusting the anode-cathode space where a current analysis of the anode sets shows that adjustment is required, and balancing the current to the anode set by adjusting any anode post in the anode set when a measurement of current to the anode set exceeds the deviation range, $k_2$, from an average current, $I_S$, to the anode set.

DETAILED DESCRIPTION OF THE INVENTION

Figure 1:
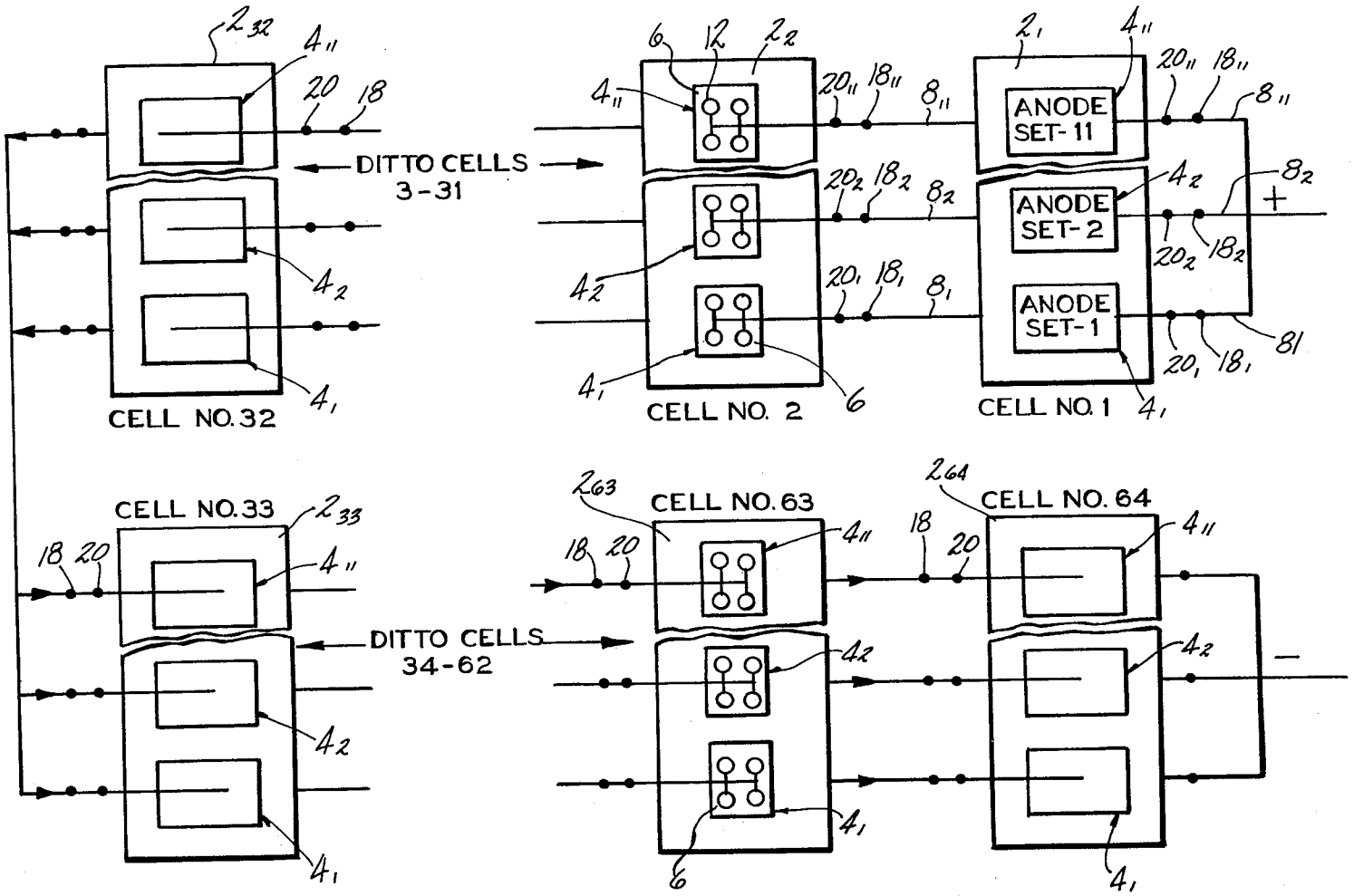
FIG. 1 is a schematic drawing of the electrical connections of a plurality of electrolytic cells operated in accordance with the process of this invention.

The present invention is particularly applicable for use in connection with a plurality of electrically interconnected mercury cells.

FIG. 1 depicts a typical electrical arrangement wherein 64 mercury cells 2 as previously described are electrically connected in series with two rows of cells, 32 cells in a row. Each cell 2 is designated in the cell room by a different number for reference purposes as indicated on the drawing with the subscript to reference numeral 2 indicating the particular cell number.

Each cell 2 is provided with eleven anode sets 4. Each anode set 4 is designated within the individual cell 2 by a different subscript for reference purposes as indicated on the drawing with the subscript to reference numeral 4 indicating the particular anode set number.

Each anode set 4 contains one anode 6. Anode sets 4 of a given cell 2 are electrically connected in parallel to the cathode (not shown) of a preceding cell 2 by an anode bus 8.

Each anode set 4 is provided with four anode posts 12 and arranged in two parallel rows. One of the anode buses 8 is connected to each of the anode posts 12 in a given anode set 4 by an anode post distributor (not shown). The other end of the anode bus 8 is connected to a terminal at the metallic bottom (not shown) of the cell 2 at a point adjacent to its associated anode 6. Current from plant supply (not shown) is conveyed to each of the anode buses 8 of cell $2_1$ and then to anode posts 12 associated with the particular anode bus 8. Current from anode posts 12 passes to anodes 6 of anode set 4, through the electrolyte (not shown), the mercury amalgam (not shown) to the bottom (not shown) of cell $2_1$.

Each of the anode buses 8 of cell $2_1$ carry current from the bottom of cell $2_1$ to their associated anode posts 12 in the top of cell $2_2$, through the anode posts 12, the anodes 6, electrolyte, and mercury amalgam to the bottom of cell $2_2$ and through anode buses 8 to the top of the next adjacent cell $2_3$ (not shown). In a similar matter, current is carried to all of the cells 2 in the cell room that are electrically connected together.

Each anode bus 8 of each cell is tapped as indicated in FIG. 1. This is accomplished by providing spaced terminals or taps 18 and 20 along each anode bus 8. The subscripts used in connection with the spaced terminals 18 and 20 indicate the particular bus that is being tapped for current and voltage measurements. For example, terminal $18_{11}$ indicates terminal 18 associated with anode bus $8_{11}$ of the first anode set $4_1$. The terminals between 18 and 20 of each anode bus are used to generate a direct current millivolt signal proportional to current flow. A voltage signal proportional to voltage drop across an anode set 4 associated with a given anode bus for a given cell is generated between terminal 20 of one cell of one bus 8 and terminal 20 of bus 8 of the next cell. For example, the signal for the voltage drop for cell 1, reference number $2_1$, in FIG. 1, associated with anode bus $8_{11}$ and the anode set $4_{11}$, is generated by using signals from terminals $20_{11}$ of bus $8_{11}$ of cell $2_1$ and terminal $20_{11}$ of bus $8_{11}$ of cell $2_2$.

The input signals from terminals 18 and 20 may be temperature compensated by an appropriate electrical circuit as a thermistor circuit (not shown) as described in U.S. Pat. No. 3,900,373, supra, and which is incorporated herein in its entirety. The input signals from terminals 18 and 20 may also be filtered by a filter (not shown).

Each of the anode sets 4 of a cell have a motor control circuit (not shown) associated therewith which when operated causes all of the anode sets 4 to be raised or lowered simultaneously with respect to the cathode. All the anode sets of a cell are raised or lowered simultaneously by the use of a single motor.

A variety of mechanical adjustment may be employed to raise or lower the anode sets of a cell. For example, U.S. Pat. No. 3,960,694, issued to Fred Champion et al on June 1, 1976 and incorporated herein in its entirety by reference, discloses a mechanical interelectrode distance adjustment means for a mercury cell.

In that patent, a plurality of worm gears are employed to adjust the height of a plurality of anodes attached to arms secured to a central anode support member which is operated by the plurality of worm gear apparatus.

The method of the present invention may be used on a variety of electrolytic cell types used for different electrolysis systems but is particularly useful for cells employed in the electrolysis of alkali metal chlorides such as sodium hydroxide to produce a halogen such as chlorine and alkali metal hydroxides such as sodium hydroxide. More particularly, this invention is highly suitable for horizontal electrolytic cells having a flowing liquid metal cathode such as mercury, as disclosed, for example, in U.S. Pat. No. 3,390,070, supra, and U.S. Pat. No. 3,574,073, supra, which are hereby incorporated by reference in their entirety.

As indicated in U.S. Pat. No. 3,574,073, supra, horizontal mercury cells usually consist of a covered elongated trough sloping slightly towards one end. The cathode is a flowing layer of mercury which is introduced at the higher end of the cell and flows along the bottom of the cell toward the lower end. The anodes are generally composed of rectangular blocks of graphite or titanium rods or mesh coated with a metal oxide. The anodes are suspended from conductive lead-ins, for example, graphite or protected copper tubes or rods. The bottoms of the anodes are spaced a short distance above the flowing mercury cathode during cell operation. The electrolyte, which is usually a salt brine such as sodium chloride flows above the mercury cathode and also contacts the anode. For each anode in each set, one anode lead is secured to a conductor, and the other lead is secured to a second conductor. Each conductor is adjustably secured at each end to a supporting anode post. Each set of supporting anode posts is provided with a mechanical adjustment means attached to the upper portion thereof, and is described more fully hereafter.

Although this invention is particularly useful in the operation of horizontal mercury cells used in the electrolysis of brine, it is generally useful for any liquid cathode type electrolytic where adjustment of the anode-cathode space is necessary.

The number of electrolytic cells controlled by the method of this invention is not critical. Although a single electrolytic cell can be controlled, commercial, operations containing more than 128 cells can be successfully controlled. In carrying out the method of this invention, each electrolytic cell contains in the range from about 2 to about 200, and preferably in the range from about 4 to about 100 anodes per cell.

The anodes of a typical mercury cell are grouped in sets. An anode set may contain a single anode, but it is preferred to include in the range from 1 to about 20 and preferably in the range from about 3 to about 12 anodes per anode set. Each anode has at least one conductor, but preferably has at least two conductors.

A digital computer is usually employed in obtaining current and voltage measurements of each anode set across terminals 18 and 20, and in operating the motor drives to adjust the position of the anodes.

When a particular electrolytic cell is selected for adjustment by the process of this invention, a series of N current measurements are obtained of the current to each anode set of the selected cell for a predetermined period. In addition, a series of N voltage measurements are obtained of the total voltage across each anode set of the selected cell for a predetermined period. These measurements are generally obtained through computer operation.

N is in the range from 1 to about 30 and preferably from about 5 to about 20.

The average current to and average voltage across each anode set of the cell is calculated.

The current flow in the conductor for the anode set is obtained by measuring the voltage drop between a plurality of terminals, for example, terminals 18 and 20, spaced apart a fixed suitable distance along an anode bus 8 to an anode set 4. The spacing suitably varies between 3 and 100 inches, for example, about 30 inches, but should be the same distance for all conductors. It is desirable, but not essential, that the terminals be located laterally in the middle of the conductor, in a straight segment of conductor of uniform dimensions. Current measurements may also be obtained using other well-known methods such as by the Hall effect or other magnetic detection devices.

The voltage signal is generated and measured between corresponding terminals on the anode bus for corresponding anode sets on two adjacent cells when a multiplicity of cells are controlled.

Current measurements are retained for this position of the anode sets and are utilized as described below in a second current analysis.

The total voltage drop across an anode set is the result of the effect of at least three individual components. These are in descending order of importance:

a. Brine decomposition voltage.

b. Gap related resistance (brine in gap).

c. Non-gap related resistance.

The brine decomposition voltage is a constant for a given electrolyte.

The anode set is mathematically modeled and controlled employing the voltage equation (1):

$$V_a = V_D + (V_c)\left(\frac{KA}{M^2}\right) \quad (1)$$

where:

1. $V_a$ is the voltage across the anode set, in volts,
2. $V_D$ is the decomposition voltage, in volts, for the particular electrolyte, and particular anode employed,
3. KA is the current in kiloamperes to the anode set, and
4. $M^2$ is the area in square meters of the cathode surface area below the anode set, and
5. $V_c$ is the cell voltage coefficient in volts per kiloampere per square meter.

Equation (1) is employed to mathematically model and control all the individual anode sets of an electrolytic cell.

It can be seen that as the anode set voltage coefficient is reduced for a constant cell current and cathode area, that the anode set operating voltage will approach the decomposition voltage for the selected electrolyte. Thusly, the term $(V_C)(KA/M^2)$ represents the sum of the gap and non-gap related resistances to current flow in the anode set. As $V_c$ becomes smaller, the anode set voltage will decrease, and for the same current, the power requirements will decrease.

At startup, a standard voltage coefficient, S, is calculated for each anode set of each electrolytic cell positioned at a space of at least 3 mm between the anode and the cathode in accordance with the equation (1): rewritten as equation (2):

$$S = \frac{V_a - V_D}{KA/M^2} = V_c \quad (2)$$

where:

1. $V_a$ is the average voltage across the selected anode set, in volts,
2. $V_D$ is the decomposition voltage across the anode set for the particular electrolyte, about 3.2 volts for an aqueous solution of sodium chloride when metal anodes are employed,
3. KA is the average current in kiloamperes to the anode set, and
4. $M^2$ is the area in square meters of the cathode surface below the anode set, about 6.38 square meters for an Olin E-8 cell.

A predetermined deviation limit, $k_1$, is established for S where $k_1$ is in the range from about 0.2 to about 15.0 and preferably in the range from about 0.5 to about 10.0 percent.

The $V_c$ calculated for each of the anode sets is analyzed to note the $V_c$ having the lowest value. This anode set $V_c$ becomes the controlling voltage coefficient in comparison with S the standard voltage coefficient.

The standard voltage efficient, S, may vary with a number of factors such as the material of construction of the anode (graphite or metal), the form and condition of the anodes (blocks of graphite which are slotted or drilled, metal mesh or rods coated with a noble metal or oxide) and the location of the anode set in the cell, among other factors. As indicated in "Intensification of Electrolysis in Chlorine Baths with a Mercury Cathode", *The Soviet Chemical Industry*, No. 11, November, 1970, pp. 69–70, the standard voltage coefficient (S) was found to vary as follows:

| S, Standard Voltage Coefficient, $V/KA/M^2$ | Condition |
|---|---|
| 0.55 | no device for regulating anode position |
| 0.3 | use of device for lowering anodes |
| 0.2 | intensive perforation of anodes |
| 0.14 | increased perforation of anodes and increased electrolysis temperature |
| 0.09 | use of titanium anodes with ruthenim dioxide coating |
| 0.022 | anodes specially placed in the amalgam |

This standard voltage coefficient is suitably raised or lowered as the condition for the anode set changes. It can be stored in the memory core of a computer and compared with the calculated Vc when desired.

Voltage coefficient, $V_c$, is compared for predetermined standard coefficient, S, to see if the value of $V_c$ falls outside of $k_1$, where $k_1$ is the permissible range of deviation from S.

The spacing between all anode sets and the cathode is adjusted where the difference between $V_c$ and S falls outside the deviation, $k_1$, and comprises a. increasing the space between all anode sets and the cathode by a predetermined distance where $V_c$, is below S by an amount exceeding $k_1$, and,
b. decreasing the space between all the anode sets and the cathode by a predetermined distance where $V_c$ is above S by an amount exceeding $k_1$, If $V_c$ is above S in excess of $k_1$, all the anode sets are lowered a predetermined amount and a new anode set voltage coefficient is calculated for each anode set. The spacing between a selected anode set and cathode is again adjusted as described above until the difference between $V_c$ and S falls inside the deviation, $k_1$.

Desirable, voltage coefficients for operating anodes are normally in the range from about 0.130 to about 0.140 volts per kiloampere per square meter. Anode sets at the cell ends such as numbers 1 and 11 are positioned individually higher than anode sets 2 through 10, to provide an additional safety margin at each end of the cell.

Following a decrease in the anode-cathode spacing to a position where $V_c$ is within predetermined limits, a series of N current measurements for all anode sets are taken for a predetermined period within the above-defined ranges, where N is as defined previously. Each current measurement at each anode set is compared with the retained preceding current measurement for that anode set in a series of current analysis hereafter described to determine the amount of current increase. Where the current increase exceeds one of several predetermined limits, the anode-cathode spacing for all anode sets is immediately increased a predetermined distance to avoid short-circuiting.

In a first current analysis, if the increase in current between the current measurements made immediately before and immediately after the decrease in anode-cathode spacing for each of the anode sets is greater than a predetermined limit, the anodecathode spacing for all the anode sets is immediately increased. For example, if the anode sets are lowered a distance within the above-defined ranges, for example, about 0.3 mm, and an increase in current in excess of a predetermined limit occurs, for example, an increase of more than about 5 percent above the previous current measurement, the anode-cathode spacing is immediately increased a distance within the above-defined ranges. If the decrease in anode-cathode spacing is smaller than 0.3 mm, a proportionately smaller increase in current differences is used as a limit to effect raising of the anode sets.

In a second current analysis, if the anode sets have not been raised in the first current analysis, a series of N current measurements are taken for anode buses for a predetermined period in the ranges described above to determine the magnitude of current fluctuations. The second current analysis is made based upon the average magnitude of the current fluctuations or differences as determined by any convenient method prior to comparing with a predetermined average difference limit. This average difference limit is determined, for example, by doubling the average difference in the current measurements made in the series N when the anode set was initially installed at a large gap between the anode and cathode of at least about 3 mm. The average difference in current in the series of measurements obtained at the initial position generally ranges from about 0.2 to about 0.4 percent of the current to the anode set in that series and thus the predetermined limit for average current difference in a series N ranges from about 0.4 to about 1.6 percent. The term "average difference" when used in the description and claims to define the magnitude of the current fluctuations is intended to include any known method of averaging differences. For example, in a preferred embodiment, a calculation is made for $\Sigma\Delta^2/N$, where $\Delta$ is the difference in current between each successive reading in the series and N is the total number of current measurements taken. If this average difference is greater than the predetermined average difference limit, the anode-cathode spacing is immediately increased a predetermined distance. As an alternate, the average difference may be obtained by the calculation $$\sqrt{\frac{\Sigma\Delta^2}{N}}$$

or any other similar statistical technique.

A third current analysis is made from the series N of current measurements to determine if the current continues to increase for each measurement during series N during a predetermined time period described above. If the current continues to increase for each measurement, the anode-cathode spacing is immediately increased, for example, to the previous position. The number of measurements and the predetermined time period used in this analysis are within the ranges described above, but are more preferably about 180 measurements in four seconds.

A fourth analysis of the current measurements determines whether an increase in current for any two measurements during series N, is greater than a predetermined limit, for example, an increase of about 6–8 percent. If so, the anode-cathode spacing is immediately increased.

A fifth current analysis compares each current measurement in the series with the previous current measurement, and if the difference between two successive current measurements exceeds a predetermined limit, the distance between the anode and cathode is increased. When one current measurement is exceeded by the next successive current measurement in an amount from about 0.5 to about 3.0 percent, and preferably from about 1.0 to about 1.5 percent of the prior current measurement, the distance between the anode and cathode is increased.

In a sixth current analysis, if any current measurement exceeds the average bus current for the entire electrolytic cell by a difference ranging from 10 to 50 percent and preferably from about 20 to about 40 percent of the average cell current for the entire electrolytic cell, then the anode set is raised a predetermined distance.

It is recognized that other current analysis may be employed in the process of this invention to detect and avoid incipient short-circuiting of the anodes to cathode. Combinations of the aforementioned current analysis methods may be employed. Typically the anode set having the highest current will be monitored closely to avoid short-circuiting.

If any current analysis require raising of the anode set a predetermined distance, a new series of current and voltage measurements are obtained and a new voltage coefficient, $V_c$, is calculated. If the calculated voltage coefficient is below S by more than deviation, $k_1$, the anode set is raised a small distance within the ranges described above. If the calculated voltage coefficient is above S by more than deviation, $k_1$, the anode set is lowered a predetermined distance. If the new voltage coefficient is within the limit, $k_1$, then the current analyses are repeated.

After the anode sets for a selected cell are adjusted with the computer by voltage coefficient and current analysis, the anode sets and the anode posts are current balanced individually by a procedure involving a combination of calculations and manual adjustments of the anode posts.

In this procedure, an average anode set current, $I_{SA}$ is first calculated in accordance with equation (3):

$$I_{SA} = \frac{I_T}{N_1} \tag{3}$$

where:

1. $I_T$ is a total current to the cell in kiloamperes, and
2. $N_1$ is the number of anode sets in the selected cell. $N_1$ is in the range from about 1 to about 20 and preferably from about 4 to about 12 anode sets per cell.

For example, a total current $I_T$ to the cell is about 49.5 kiloamperes, which is normally supplied to each cell through eleven parallel buses, each bus feeding one anode set. Each anode bus (and anode set) carries an average anode set current $I_{SA}$ of about 4.5 kiloamperes.

A predetermined anode set current deviation range, $k_2$, is calculated for the selected cell. Deviation range, $k_2$, normally ranges from about 1 to about 10 and preferably from about 2 to about 5 percent above and below, $I_{SA}$, the average anode set current.

The anode post adjustment procedure is comprised of a calculating step in which an average current, $I_{PA}$, for each anode post of a selected anode set is calculated in accordance with equation (4):

$$I_{PA} = \frac{I_{SA}}{N_2} \quad (4)$$

where:

1. $I_{SA}$ is the average current to an anode set of the selected cell, and
2. $N_2$ is the number of anode posts on the selected anode set of the selected cell. $N_2$ is in the range from about 1 to about 20 and preferably from about 2 to about 10 anode posts per anode set.

An anode post current deviation range, $k_3$, is then calculated for $I_{PA}$. This anode post current deviation range, $k_3$, normally ranges from about 1 to about 20 and preferably from about 10 to about 15 percent above and below $I_{PA}$.

The motor control for the selected cell is then placed on manual and the anode set current, $I_S$, is measured. If the anode set current, $I_S$, is within the deviation range, $k_2$, no adjustment is required to be made and generally the current for another set is measured. If desired, however, the anode posts of that anode set may be adjusted as described hereafter. This procedure is continued until an anode set current, $I_S$, is found in an anode set which is outside current deviation range, $k_2$. When this occurs, the position of the anode posts in the anode set is adjusted as described below.

In the next step of the anode post procedure, the anode post current, $I_p$, to a selected anode post in the selected anode set is then measured by employing a portable current measuring instrument. This instrument is preferably a clamp-around, non-containing device having a current measurement capability in the range from about 0 to about 100 kiloamperes and preferably from about 1 to about 5 kiloamperes. It is desirable that the particular instrument employed remain unaffected by the presence of a high ambient flux field incurred by equally active conductors in the immediate area of use.

One particular portable current measuring instrument which may be employed in the process is a portable ampere meter which is clamped on each anode post and the instantaneous current is read on the ampere meter readout.

A typical portable ampere meter which may be employed is a HALMAR® ampere meter Model COP, manufactured by Halmar Electronics Inc., Columbus, Ohio.

The anode post current $I_P$ for the selected anode post is measured and if it is within deviation range, $k_3$, another anode post in the same set is selected for measurement of $I_P$. When an anode post current $I_P$ is found which exceeds deviation range, $k_3$, the following procedure is employed. While measuring $I_P$ continuously, the space between the selected anode post and the cathode is increased by an amount sufficient to lower $I_P$ to within the deviation range, $k_3$. The space between the selected anode post and the liquid cathode is decreased where $I_P$ is initially below deviation range, $k_3$, and such decreasing is continued until $I_P$ is within deviation range, $k_3$.

For each selected anode post, the above steps are repeated as necessary until $I_P$ for each anode post in the anode set is within deviation range, $k_3$.

The anode posts are adjusted by manual means, for example, by mechanically loosening the anode post and positioning the anode post further from the cathode so that the ampere meter measurement will be within deviation range, $k_3$. After the anode post is adjusted and retightened, then the ampere meter is employed to check the instantaneous current on the anode post. If the instantaneous current is within $k_3$, then the ampere meter is moved to the next anode post within that anode set. This procedure is repeated for each anode post of a selected set until all of the anode sets of the selected cell have been adjusted as previously described and are in current balance with one another. The cell is then placed under computer control and the same procedure is repeated on each cell until current balancing of the anode sets and anode posts are completed.

During the calculation and manual adjusting procedures previously described, the current to each anode set is continuously monitored to observe an increase or decrease in current to any of the other anode sets after the adjustment is completed on a selected anode set. Such observation may indicate that all the anode sets should be raised or lowered manually. In addition, anode sets may be selected for manual adjustment in addition to those anode sets selected originally. A typical device which may be employed to monitor the current to each of the anodes sets of a selected first cell is an oscilloscope such as a monitoring Hewlett Packard Model 1220.

The process of this invention now permits fine current balancing of the individual anode posts within a given set of anodes. After initial adjustment with automatic controls after manual control is completed, the automatic control system is then employed to check the system and raise and lower the entire set of anodes thereby resulting in a more efficient anode-liquid cathode adjustment for the entire cell.

The present invention is particularly applicable for use in connection with a plurality of electrically interconnected mercury cells.

All anode sets in a selected cell may be simultaneously adjusted using the above method. The method of the second current analysis can also be employed to locate in a series of adjacent cells, the cell having the highest amount of current fluctuation.

In a further embodiment of the method of the present invention, all anode sets for all cells in operation are serially checked periodically and the current and voltage readings for each anode set measured and compared with their predetermined value ranges. Where the current reading exceeds the above-defined predetermined limits, the anode-cathode spacing is increased. This periodic check detects current overloads to any anode set on a continuing basis. If during a check, the anode-cathode spacing for an anode set is increased, the check is repeated for all anode sets for all operative cells.

If any one of the current analyses indicates that the distance between an anode set and the cathode must be increased, the anode set is raised to the original starting position and a new standard voltage coefficient, S, is selected. The new standard voltage coefficient, S, is increased a predetermined amount above the initial standard voltage coefficient, S. Generally, the increase is from about 5 to about 20, and preferably from about 10 to about 15 percent of the initial standard voltage coefficient. The abovedefined procedure for positioning the anode set based upon voltage coefficient is then repeated until a position is found where the voltage coefficient is within the above-defined predetermined range.

When calculations show that the voltage coefficient and current measurements to be within predetermined limits, the anode set is lowered a predetermined distance, r, obtain another set of measurements of current and voltage coefficient and continue lowering anode set incrementally a predetermined distance until that the anode set should be raised a predetermined distance, r. The anode set is lowered a fraction of r, for example, ½r, and a new set of measurements are obtained. If measurements do not require moving anode set from this position, it is retained at that position until subsequent analysis shows the need for further adjustment.

The following examples are presented to define the invention more fully without any intention of being limited thereby.

EXAMPLE 1

Example 1 illustrates the anode-cathode adjustment procedure of the process of this invention as employed on one cell selected from a group of 64 electrolytic cells employed to produce caustic soda and chlorine by the electrolytic decomposition of an aqueous sodium chloride brine.

The cells were electrically connected in a series arrangement.

The mercury cell construction was similar to the cell described in U.S. Pat. No. 3,574,073, supra, and was comprised of a cell body, a cell cover, and had anodes positioned above a flowing mercury cathode. Anode posts were secured to the cell cover as described in U.S. Pat. No., 3,060,694, supra. The anode posts extended through openings in the cover and an anode adjustment means for operating upon the anode posts to adjust the interelectrode distance.

The selected cell was fed an aqueous solution of a sodium chloride brine at a feed rate of about 8.5 gallons per minute. The inlet brine concentration was about 308 grams sodium chloride per liter and the outlet brine concentration was about 260 grams per liter. The brine inlet temperature was about 59° C. while the brine outlet temperature was about 83° C. The electrical current supplied to the cell was about 49.5 kiloamperes. The anode sets were arranged in a parallel electrical connection in a selected first cell.

Typically, each anode bus of the cell was tapped by providing spaced terminals along each anode bus conductor.

The spaced terminals of each anode bus were used to generate a direct current millivolt signal proportional to current flow in that particular bus. A voltage signal proportional to the voltage drop across an anode set associated with a given anode bus for a given cell was generated by using a terminal of the succeeding series cell.

Both input signals from the bus terminals were temperature compensated by a thermistor circuit as shown and described in U.S. Pat. No. 3,900,373, supra.

The instantaneous current and voltage measurement for each of the eleven anode sets of the selected first cell was displayed on an output screen of a monitoring Hewlett Packard Model 1220 oscilloscope monitoring the operation of cell No. 57 in the series of 64 cells.

A digital computer system as described in U.S. Pat. No. 4,082,639, supra, was employed for automatic control of the anode-liquid mercury cathode interelectrode distance.

The output of the computer was coupled to the mechanical interelectrode adjustment means described in U.S. Pat. No. 3,960,694, supra, by a motor control circuit.

The mechanical interelectrode adjustment means for mercury cells was comprised of a plurality of worm gears employed to adjust the height of a plurality of anodes attached to arms secured to a central anode support member.

The particular cell selected for this example, cell No. 57, had eleven anode sets per cell, one anode per anode set and had four anode posts per anode set. All the eleven anode sets of the selected first cell were raised or lowered simultaneously by employing the digital computer-gear arrangement previously described.

Current and voltage signals for all eleven anode sets were transmitted simultaneously to an automatic control unit, a digital computer, for about 5 seconds until about 180 readings of current and of voltage were received for each anode set. The average voltage, current, and the differences between each current reading and the previous current reading were determined by the digital computer for the series of readings. The voltage coefficient was calculated for each anode set according to the formula:

$$V_c = \frac{V_a - 3.1}{KA/M^2}$$

When $V_c$ was compared with its standard coefficient, S, of 0.145 was found to have for all the anode sets, a value above the deviation range, $k_1$, where $k_1$ was about ±0.004. When the coefficient comparison determined the value of $V_c$ was above S by a value greater than $k_1$, a signal from the computer activated a relay which energized a hydraulic motor to lower anode sets to decrease the anode-cathode spacing by about 0.3 mm. Following the decrease in anode-cathode spacing, the following sequence of operations were performed.

After the anode sets for a selected cell were adjusted with the computer by voltage coefficient and current analysis, the anode sets and anode posts were current balanced individually by the procedure described fully hereafter involving calculations and manual adjustment of the anode posts.

The total current supplied to cell No. 57 was measured at about 49.5 kiloamperes. In an anode set current balance situation, each of the individual anode sets of an electrolytic cell should carry approximately equal current. In accordance with equation (3), $I_{SA}$, the average current per anode set for cell No. 57, was calculated to be about 4.5 kiloamperes per anode set.

Table I, Anode Adjustment on Cell No. 57, shows the average current and average voltage for each anode set of cell No. 57 both before and after anode adjustment involving calculations and manual adjustment of the anode posts. As readily seen from Table I, the respective current to the various anode sets indicated a severe current imbalance between the eleven anode sets of cell No. 57.

The variance, $k_2$, for the anode set current was selected at about 9 percent the value of the average anode set current above and below, $I_{SA}$, the average anode set current. Thus, the deviation range was about ±0.4 kiloampere so that all anode sets whose current, $I_S$, exceeded about 4.95 kiloamperes or whose current, $I_S$, was less than about 4.15 kiloamperes were originally selected for anode set current balancing.

As can be seen from Table I, $I_S$, the current to anode sets 1, 2, 3, 4, 5, 8, 9 and 11 was outside the variation limit, $k_2$, from $I_{SA}$, the average anode set current, and were therefore originally selected for current balancing.

The higher than desired current to anode set 3, for example, indicated that at least one anode post in anode set 3 was required to be moved further from the cathode.

The lower than desired current to anode set 5, for example, indicated that at least one of the four anode posts within anode set 5 was required to be positioned closer to the cathode.

Cell No. 57 was adjusted according to the process of this invention.

First, as shown in Table I, the current to each of the eleven anode sets for cell No. 57 was recorded.

Cell No. 57 interelectrode distance control was placed in a manual control position with the motor control circuit system in a hold "as is" position.

ing anode sets 2, 3, 4, 5, and 11 selected for anode adjustment within cell 1, one anode set at a time.

During the anode post adjustment on a selected anode set, the current to the other anode sets of cell No. 57 was monitored employing a monitoring Hewlett Packard Model 1220 oscilloscope. It was not necessary to raise or lower all anode sets simultaneously employing manual mode while the calculation and manual adjustment procedure was in progress. After adjustment of anode sets 1, 2, 3, 4 and 5, it was not necessary to adjust the anode posts of anode sets 8 and 9.

The results of the calculation and manual adjustment procedure resulted in a significant smoothing and balancing of the current within the particular cell 1, as shown in Table I, After Adjustment.

The anode adjustment system was then returned to automatic control using the digital computer.

TABLE I

| | ANODE ADJUSTMENT ON CELL NO. 57 | | | | | | | | | | |
|---|---|---|---|---|---|---|---|---|---|---|---|
| Before Adjustment Anode Set No. | 1 | 2 | 3 | 4 | 5 | 6 | 7 | 8 | 9 | 10 | 11 |
| Current, KA | 4.99 | 4.91 | 5.46 | 3.89 | 3.83 | 4.32 | 4.31 | 3.96 | 4.07 | 4.29 | 5.35 |
| Voltage, KV | 4.14 | 4.10 | 4.18 | 4.28 | 4.25 | 4.22 | 4.25 | 4.30 | 4.29 | 4.28 | 4.31 |
| Anode Set Adjusted | X | X | X | X | X | | | | | | X |
| After Adjustment | | | | | | | | | | | |
| Current, KA | 4.84 | 4.64 | 4.63 | 4.50 | 4.43 | 4.44 | 4.47 | 4.43 | 4.47 | 4.40 | 4.63 |
| Voltage, KV | 4.16 | 4.10 | 4.18 | 4.24 | 4.22 | 4.21 | 4.22 | 4.26 | 4.25 | 4.24 | 4.26 |

The current, $I_p$, to each of the four anode posts within the first anode set of cell 1 was balanced as hereafter described.

In accordance with equation (4), $I_{PA}$, the average current to the anode posts of the first anode set was calculated to be about 1.1 kiloamperes per anode post.

The deviation limit on the anode posts was selected at about 10 percent the value of the average anode post current above and below the average anode post current. Thus, the deviation range was about ±0.1 kiloampere. Thus, all anode posts of the first anode set whose current, $I_P$, exceeded about 1.2 kiloamperes or was less than about 1.0 kiloampere were selected for anode post current balancing.

A clamp-on portable ampere meter was employed to determine the instantaneous current to the first of the four individual anode posts within the first anode set. The current on the first anode post measured about 1.3 kiloamperes on the ampere meter.

Since current measured greater than about 1.2 kiloamperes upper limit, the anode post was mechanically loosened and moved slightly away from the cathode. The anode post was retightened in place.

The ampere meter was then employed to determine if the instantaneous current to that anode post was closer to about 1.1 kiloamperes. After the adjustment, the current on the first selected anode post measured about 1.1 kiloamperes. The same procedure was repeated on the next anode post within the first anode set.

For those anode posts where the instantaneous current was less than about 1.1 kiloamperes, the anode post was mechanically loosened and the anode post was moved closer to the cathode. The ampere meter was employed to determine the instantaneous current after the movement. The anode post is loosened and retightened until the ampere meter indicated that the instantaneous current was about 1.1 kiloamperes.

After each of the four anode posts was adjusted within a first selected anode set, the similar procedure was repeated on each of the anode posts of the remain-

EXAMPLE 2

In Example 2, the same procedure was employed as in Example 1 except that the procedure was employed on 32 electrolytic cells. All of the electrolytic mercury cells were employed to produce chlorine and sodium hydroxide by the electrolytic decomposition of a sodium chloride brine. The mercury cells were of the type described in Example 1. All the anode sets of all the cells employed in Example 2 were raised and lowered simultaneously.

Table II, Anode-Cathode Adjustment of Mercury Cells, details the average voltage and average current measurements to each of the mercury cells employed in this example before and after the calculations and manual adjustment of the anode posts were performed. Twenty-eight cells were in steady state operation before the manual adjustment was initiated. During the adjustment, four additional cells, 21, 22, 29, and 30, were placed into operation and thereafter adjusted by the process of this invention.

Prior to this manual adjustment, the anode-liquid cathode distance had been controlled by the digital computer-gear arrangement as described in Example 1 for a period of about 24 hours. The average cell voltage coefficient for 28 selected cells before the adjustment was calculated to be about 0.160 volt per kiloampere per square meter.

As the anode posts of each cell were further adjusted manually according to the process of this invention, the automatic control system was placed in manual mode control. In Example 2, appropriate anode sets and appropriate anode posts were selected for adjustment as described in Example 1 and were adjusted as described in Example 1. After the manual adjustment was completed on each cell, the control system was returned from manual control to automatic control for further adjustment according to the process of this invention.

The average cell voltage coefficient for 32 cells after adjustment as described above was calculated to be about 0.141 volt per kiloampere per square meter. The average cell voltage coefficient of about 0.141 volt per kiloampere per square meter is significantly closer to the desired operating cell voltage coefficient in the range from about 0.120 to about 0.140 volt per kiloampere per square meter.

The results of Example 2, as shown in Table II, illustrate the effectiveness of the process of this invention in that the overall cell voltage coefficient for the 32 cells has been markedly improved over the use of the automatic computer adjustment alone for cells where all the anode sets are raised and lowered simultaneously.

Table II

ANODE-CATHODE ADJUSTMENT OF MERCURY CELLS

| Cell | Average Anode Set Voltage (Volts) | | Current Supplied To Each Cell (Kiloamperes) | | Calculated Cell Voltage Coefficient (Volts Per Kiloampere Per Square Meter) | |
|---|---|---|---|---|---|---|
| No. | Before | After | Before | After | Before | After |
| 1 | 4.38 | 4.21 | 49.22 | 47.85 | 0.179 | 0.157 |
| 2 | 4.87 | 4.05 | 49.19 | 47.70 | 0.239 | 0.132 |
| 3 | 4.28 | 4.16 | 49.19 | 47.73 | 0.160 | 0.146 |
| 4 | 4.19 | 4.08 | 49.22 | 47.66 | 0.148 | 0.137 |
| 5 | 4.37 | 4.19 | 49.17 | 47.70 | 0.172 | 0.150 |
| 6 | 4.17 | 4.15 | 49.12 | 47.63 | 0.147 | 0.148 |
| 7 | 4.24 | 4.11 | 49.17 | 47.66 | 0.155 | 0.141 |
| 8 | 4.06 | 4.05 | 49.22 | 47.70 | 0.133 | 0.134 |
| 9 | 4.01 | 4.01 | 49.12 | 47.70 | 0.124 | 0.126 |
| 10 | 4.09 | 4.03 | 49.15 | 47.66 | 0.137 | 0.132 |
| 11 | 4.11 | 4.06 | 49.12 | 47.61 | 0.137 | 0.133 |
| 12 | 4.37 | 4.22 | 49.15 | 47.63 | 0.174 | 0.158 |
| 13 | 4.07 | 4.01 | 49.07 | 47.61 | 0.132 | 0.127 |
| 14 | 4.15 | 4.02 | 49.15 | 47.66 | 0.148 | 0.132 |
| 15 | 4.08 | 4.03 | 49.19 | 47.61 | 0.133 | 0.128 |
| 16 | 4.17 | 4.06 | 49.19 | 47.63 | 0.145 | 0.134 |
| 17 | 4.11 | 4.06 | 49.17 | 47.61 | 0.138 | 0.134 |
| 18 | 4.03 | 4.00 | 49.15 | 47.66 | 0.130 | 0.129 |
| 19 | 4.06 | 4.02 | 49.15 | 47.68 | 0.129 | 0.126 |
| 20 | 4.26 | 4.15 | 49.12 | 47.66 | 0.158 | 0.146 |
| 21 | | 4.00 | | 47.66 | | 0.124 |
| 22 | | 4.05 | | 47.70 | | 0.131 |
| 23 | 4.77 | 4.44 | 49.15 | 47.61 | 0.231 | 0.190 |
| 24 | 4.39 | 4.21 | 49.15 | 47.61 | 0.178 | 0.156 |
| 25 | 4.55 | 4.29 | 49.19 | 47.63 | 0.201 | 0.167 |
| 26 | 4.72 | 4.22 | 49.17 | 47.68 | 0.222 | 0.156 |
| 27 | 4.24 | 4.34 | 49.17 | 47.68 | 0.157 | 0.174 |
| 28 | 4.13 | 4.08 | 49.15 | 47.53 | 0.139 | 0.134 |
| 29 | | 4.03 | | 47.53 | | 0.130 |
| 30 | | 4.16 | | 47.41 | | 0.148 |
| 31 | 4.63 | 4.03 | 49.12 | 47.34 | 0.204 | 0.129 |
| 32 | 4.09 | 3.96 | 49.10 | 47.24 | 0.137 | 0.121 |

What is claimed is:

1. In a method for adjusting the anode-cathode space between electrodes in an electrolytic cell containing an electrolyte decomposable by electric current, said electrolyte being in contact with said electrodes, said electrodes being comprised of at least one anode set which is adjustable with respect to a liquid cathode in a spaced relationship, wherein said anode set has at least one electrode and a plurality of anode posts, and wherein a voltage is applied across said cathode and said anode set to develop an electric current flow through said electrolyte to effect decomposition thereof and said cell having operably connected to said adjustable anode set a motor drive means attached to raise and lower said adjustable anode set, wherein a series of N current and a series of N voltage measurements to said adjustable anode set is taken and an average current through and an average voltage across said anode set is calculated, the improvement which comprises, in combination, (a) calculating a voltage coefficient, $V_c$, for said anode set, (b) adjusting said anode-cathode space after a comparison of the calculated voltage coefficient, $V_c$, with a previously determining standard voltage coefficient, S, shows that said $V_c$ exceeds a standard deviation range $k_1$, from said S, (c) further adjusting said anode-cathode space where a current analysis of said anode set shows that further adjustment is required, (d) balancing the current to said anode set by adjusting selected anode post in said anode set when a measurement of current, $I_S$, to said anode set exceeds the deviation range $k_2$, from an average current, $I_{SA}$, to said anode set.

2. The process of claim 1, wherein said cell contains in the range from about 2 to about 12 anode sets.

3. The process of claim 2, wherein said anodes have in the range from about 1 to about 10 anode posts.

4. The process of claim 3, wherein said anode sets of said cell are each raised and lowered separately.

5. The process of claim 3, wherein said anode sets of said cell are all raised and lowered simultaneously.

6. The process of claims 4 or 5, wherein said electrolytic cell is connected in series with from about 1 to about 200 additional electrolytic cells.

7. The process of claim 6, wherein said anode set is comprised of metal anodes.

8. The process of claim 7, wherein said electrolyte is an aqueous alkali metal chloride solution.

9. The process of claim 8, wherein said electrolyte is an aqueous solution of sodium chloride.

10. The process of claim 9, wherein said cathode is mercury.

11. The process of claim 10, wherein said anode set deviation range, $k_2$, is in the range from about 1 to about 10 percent above and below $I_S$, the average anode set current.

12. The process of claim 11, wherein said anode set deviation range, $k_2$, is in the range from about 2 to about 5 percent above and below $I_S$, the average anode set current.

13. The process of claim 12, wherein said $I_{PA}$, average anode post current, is calculated in accordance with the formula $$I_{PA} = \frac{I_{SA}}{N_2}$$

where:

1. $I_{SA}$ is the average current to said anode set of said cell, and
2. $N_2$ is the number of anode posts within said anode set of said cell. $N_2$ is in the range from about 1 to about 20 and preferably from about 2 to about 10 anode posts per anode set.

14. The process of claim 13, wherein said selected anode post is spaced closer to or further from said cathode when a measurement of current, $I_p$, to said anode post exceeds the deviation range, $k_3$, from an average current, $I_{PA}$, to said anode post.

15. The process of claim 14, further comprising the steps, (e) while measuring $I_P$ continuously, increasing the space between the first anode post and said cathode by a predetermined distance where said $I_P$ is above said $I_{PA}$ by an amount exceeding said $k_3$, (f) while measuring $I_P$ continuously, decreasing the space between the first anode set and said cathode where said $I_P$ is below said $I_{PA}$ by an amount exceeding said $k_3$, (g) $I_P$ is less than the amount exceeding said $k_3$, and (h) repeating steps (e), (f) and (g) on all of selected anode posts within said anode set.

16. The process of claim 13, wherein $N_2$ is in the range from 1 to about 12.

17. The process of claim 13, wherein $N_2$ is in the range from 1 to about 4.

18. The process of claim 15, wherein said anode post deviation range, $k_3$, is in the range from about 1 to about 20 percent above and below $I_P$, the average anode post current.

19. The process of claim 15, wherein said anode post deviation range, $k_3$, is in the range from about 10 to about 15 percent above and below $I_P$, the average anode post current.

* * * * *